US007600810B2

(12) United States Patent
Chen et al.

(10) Patent No.: US 7,600,810 B2
(45) Date of Patent: Oct. 13, 2009

(54) COLLAPSIBLE HIGH CHAIR

(75) Inventors: Shun-Min Chen, Taipei (TW); Zhi Ren Zhong, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/882,762

(22) Filed: Aug. 6, 2007

(65) Prior Publication Data

US 2009/0039684 A1 Feb. 12, 2009

(51) Int. Cl.

| | |
|---|---|
| ***A47D 1/02*** | (2006.01) |
| ***A47C 7/00*** | (2006.01) |
| ***A47C 1/12*** | (2006.01) |
| ***A47B 83/02*** | (2006.01) |

(52) U.S. Cl. ..... 297/56; 297/440.24; 297/447.2; 297/153

(58) Field of Classification Search ..... 297/440.16, 297/440.24, 440.1, 153, 56, 447.2, 447.3
See application file for complete search history.

(56) References Cited

U.S. PATENT DOCUMENTS

| | | | | |
|---|---|---|---|---|
| 2,699,817 | A * | 1/1955 | Adler et al. | 297/40 |
| 2,902,084 | A * | 9/1959 | Stevens | 297/29 |
| 4,036,523 | A * | 7/1977 | Nielsen | 297/130 |
| 4,784,436 | A * | 11/1988 | Sutherland | 297/440.24 |
| 5,165,755 | A * | 11/1992 | Rho | 297/344.18 |
| 5,573,261 | A * | 11/1996 | Miller | 280/250.1 |
| 5,915,782 | A * | 6/1999 | Geldbaugh | 297/45 |
| 5,947,553 | A * | 9/1999 | Tseng | 297/39 |
| 2002/0074835 | A1 * | 6/2002 | Chalender | 297/118 |
| 2007/0290528 | A1 * | 12/2007 | Chen et al. | 297/41 |

* cited by examiner

*Primary Examiner*—Milton Nelson, Jr.
(74) *Attorney, Agent, or Firm*—Bacon & Thomas, PLLC

(57) ABSTRACT

A collapsible high chair is provided. The collapsible high chair comprises a front frame including a pair of middle front tubes and a substantially U-shaped lower front tube, the pair of middle front tubes and the lower front tube being detachably engaged with each other by fastening devices; and a rear frame including a substantially U-shaped upper rear tube and a substantially U-shaped lower rear tube, the upper rear tube and the lower rear tube being detachably engaged with each other by fastening devices. The front frame and the rear frame are pivotally connected to each other so that the front frame and the rear frame pivot and approach with respect to each other, thereby allowing the high chair to be in a collapsed state.

15 Claims, 5 Drawing Sheets

COLLAPSIBLE HIGH CHAIR

BACKGROUND OF THE INVENTION

1. Field of the Invention

The present invention relates to a high chair, and especially to a detachably collapsible high chair.

2. Description of Related Arts

In prior arts, many known high chairs are undetachable so that when they are stored or transported with relatively large volume, it is wasteful in space. As shown in FIG. 1, a conventional high chair occupies relatively large space during storage or transportation, thereby increasing in transportation cost and storage space.

SUMMARY OF THE INVENTION

Accordingly, it is an object of the present invention to provide a collapsible high chair that overcomes the problem with the aforementioned prior art.

In accordance with an aspect of the present invention, a collapsible high chair is provided. The collapsible high chair comprises a front frame including a pair of middle front tubes and a substantially U-shaped lower front tube, the pair of middle front tubes and the lower front tube being detachably engaged with each other by fastening devices; and a rear frame including a substantially U-shaped upper rear tube and a substantially U-shaped lower rear tube, the upper rear tube and the lower rear tube being detachably engaged with each other by fastening devices. The front frame and the rear frame are pivotally connected to each other so that the front frame and the rear frame pivot and approach with respect to each other, thereby allowing the high chair to be in a collapsed state.

Preferably, the front frame further comprises a substantially U-shaped upper front tube, the upper front tube and the pair of middle front tubes are detachably engaged with each other by fastening devices.

Preferably, the collapsible high chair further comprises a substantially U-shaped arm member, the arm member being pivotally connected to the front frame and detachably fixed to the rear frame.

Preferably, the collapsible high chair further comprises a seat, the seat being pivotally connected to the rear frame and sliding pivotally on the front frame.

Preferably, both side ends of the upper rear tube are detachably engaged with both side ends of the lower rear tube by the fastening devices respectively, and middle portions of both sides of the upper rear tube of the rear frame are pivotally connected to middle portions of the pair of middle front tubes of the front frame respectively.

Preferably, both side ends of the arm member are pivotally connected to upper portions of the pair of middle front tubes of the front frame respectively.

Preferably, a front portion of the arm member is detachably fixed to the upper rear tube of the rear frame.

Preferably, front portions of both sides of the seat are pivotally connected to middle portions of both sides of the upper rear tube of the rear frame.

Preferably, each of rear portions of both sides of the seat are pivotally connected to a slide member provided on an upper portion of each of the pair of middle front tubes of the front frame, so that the seat slides pivotally on the upper portions of the pair of middle front tubes of the front frame.

Preferably, each of the fastening devices has a projection for penetrating and engaging a hole provided on the tubes.

Preferably, each of the fastening devices is a substantially V-shaped spring fastener having two elastic arms, the projection being located in one of the elastic arms.

Preferably, the spring fastener is formed of metal, plastic or elastic material.

Preferably, the collapsible high chair further comprises a tray, the tray being detachably provided on the arm member.

In accordance with another aspect of the present invention, a collapsible high chair is provided. The collapsible high chair comprises a front frame including a first front portion and a second front portion detachably connected to the first rear portion by a first fastening device, and a rear frame including a first rear portion and a second rear portion detachably connected to the first front portion by a second fastening device, the first rear portion of the rear frame is pivotally connected to the first front portion of the front frame for moving away from or toward the first front portion of the front frame so that the high chair can be moved between an expanded state and a collapsed state. The second front portion and the second rear portion are detached from the first front portion and the first rear portion respectively to make the high chair in a compact volume while the high chair is in the collapsed state.

Preferably, the first fastening device includes a first V-shaped spring fastener on one of the first and second front portions and a first hole on the other of the first and second front portions, the first spring fastener includes a projection for passing through the first hole to couple the first and second front portions together, and the second fastening device includes a second V-shaped spring fastener on one of the first and second rear portions and a second hole on the other of the first and second rear portions, the second spring fastener includes a projection for passing through the hole to couple the first and second rear portions together In accordance with another aspect of the present invention, a collapsible high chair is provided. The collapsible high chair comprises a front frame including a first front portion and a second front portion detachably connected to the first rear portion, and a rear frame including a first rear portion and a second rear portion detachably connected to the first front portion, the first rear portion of the rear frame is pivotally connected to the first front portion of the front frame. The high chair is moved between an expanded state where the front frame and the rear frame are spaced from each other, and a collapsed state where the front frame and the rear frame are close to each other, the second front portion and the second rear portion are detached from the first front portion and the first rear portion respectively, and stacked on the high chair for easy packaging.

BRIEF DESCRIPTION OF THE DRAWINGS

These and other features, aspects and advantages of the present invention will become more apparent from the following description, appended claims, and accompanying an exemplary embodiment shown in the drawings, which are briefly described below.

DETAIL DESCRIPTION OF THE PREFERRED EMBODIMENT

A detachably collapsible high chair according to an embodiment of the present invention will be described below with reference to the drawings.

Figure 1:
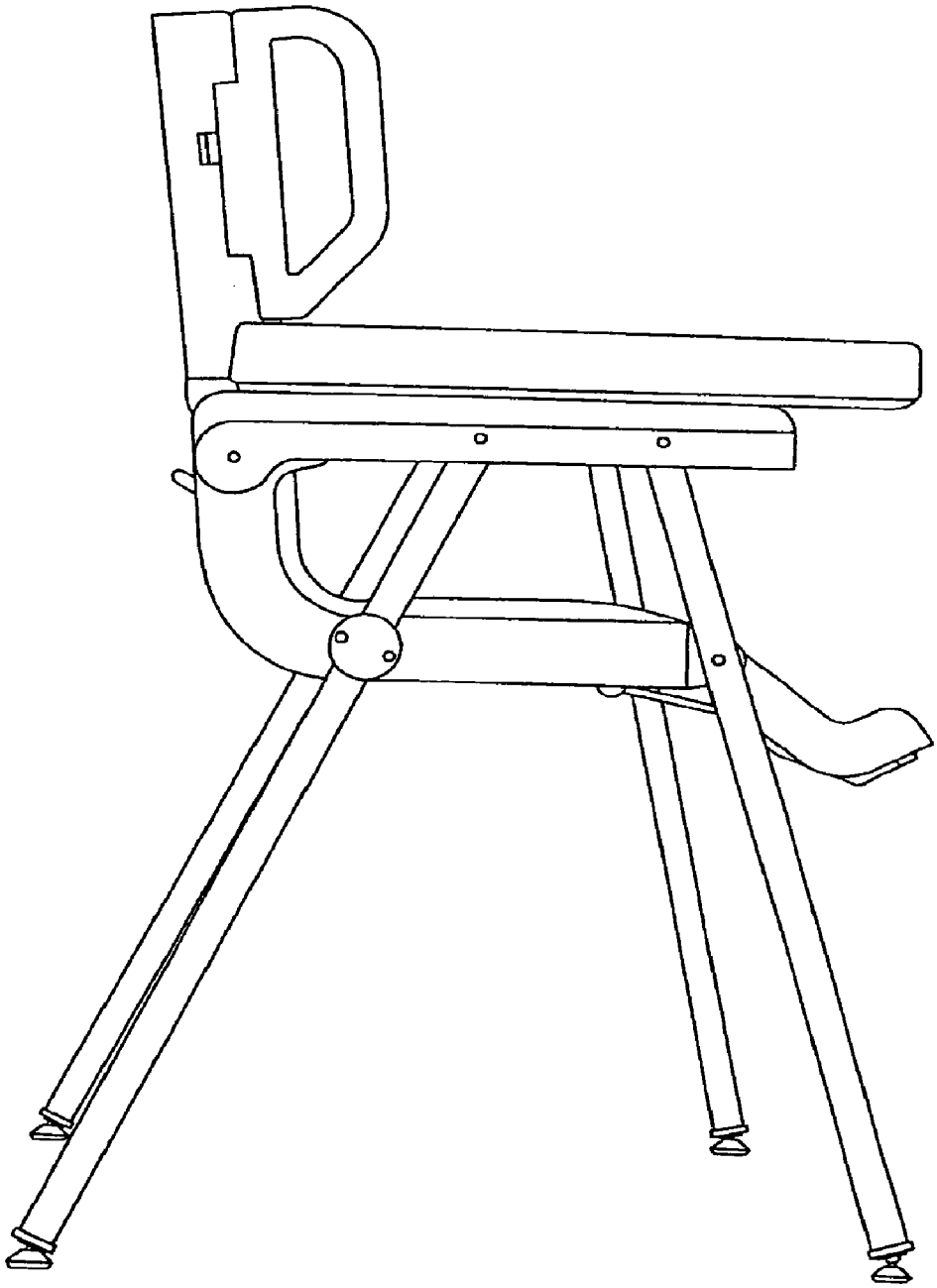
Fig. 1 PRIOR ART
FIG. 1 is a perspective view of a conventional high chair.
Figure 2:
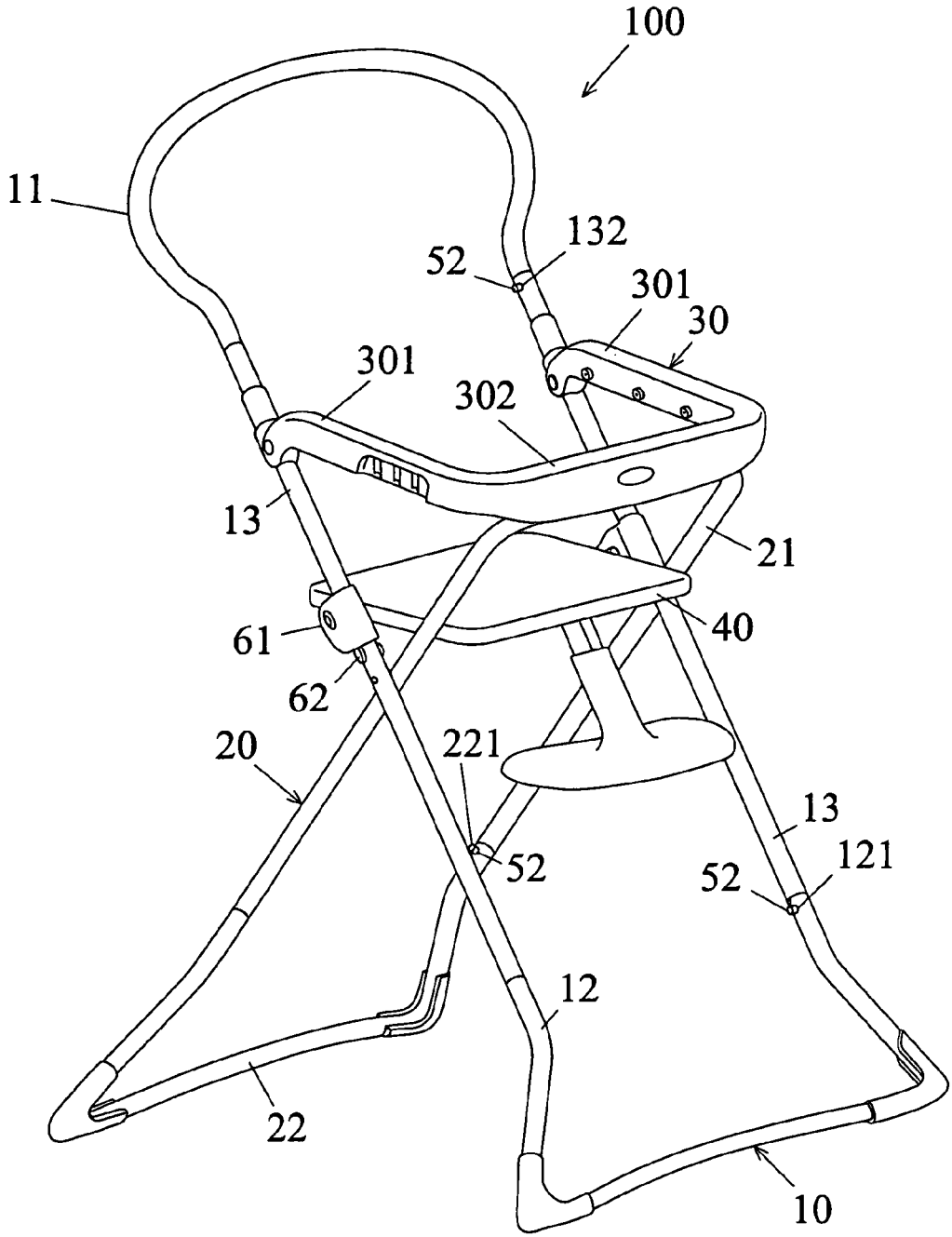
FIG. 2 is a perspective view showing a collapsible high chair according to an embodiment of the present invention.

As shown in FIG. 2, a detachably collapsible high chair 100 includes a front frame 10, a rear frame 20, a substantially U-shaped arm member 30 and a seat 40. The front frame 10 includes a substantially U-shaped upper front tube 11, a pair of middle front tubes 13 and a substantially U-shaped lower front tube 12. The rear frame 20 includes a substantially U-shaped upper rear tube 21 and a substantially U-shaped lower rear tube 22.

Both ends 301 of the arm member 30 are pivotally connected to upper portions of the pair of middle front tubes 13 of the front frame 10 respectively. A front portion 302 of the arm member 30 is detachably fixed to the upper rear tube 21 of the rear frame 20.

Front portions of both sides of the seat 40 are pivotally connected to middle portions of both sides of the upper rear tube 21 of the rear frame 20 respectively. Rear portions of both sides of the seat 40 are pivotally connected to slide members 61 which is provided on the pair of middle front tubes 13 of the front frame 10 respectively. The slide members 61 are configured to slide on the middle portions of the pair of middle front tubes 13 and is blocked at stoppers 62 provided on the middle front tubes 13.

Figure 3:
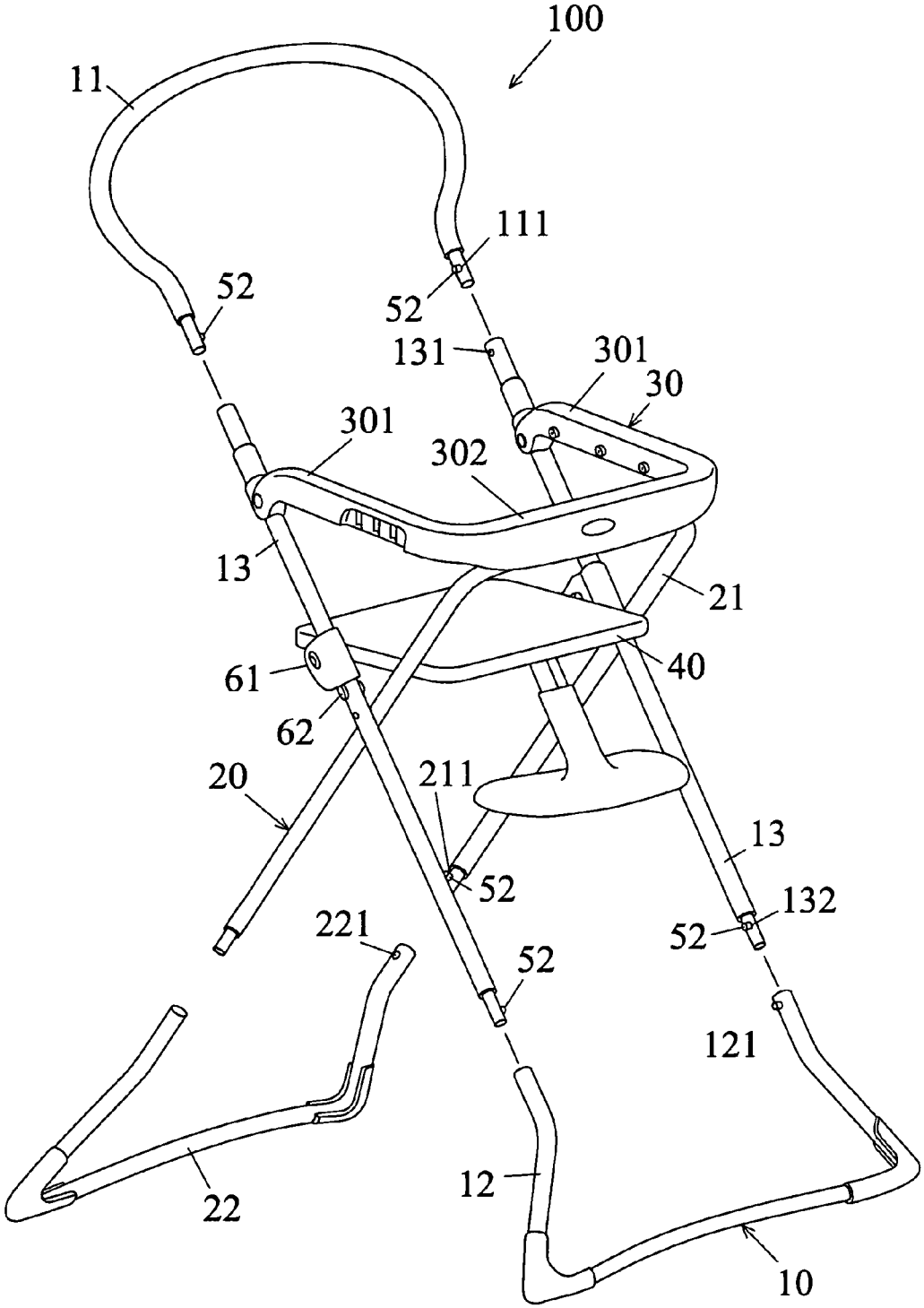
FIG. 3 is an exploded view showing the collapsible high chair of FIG. 2.
Figure 4:
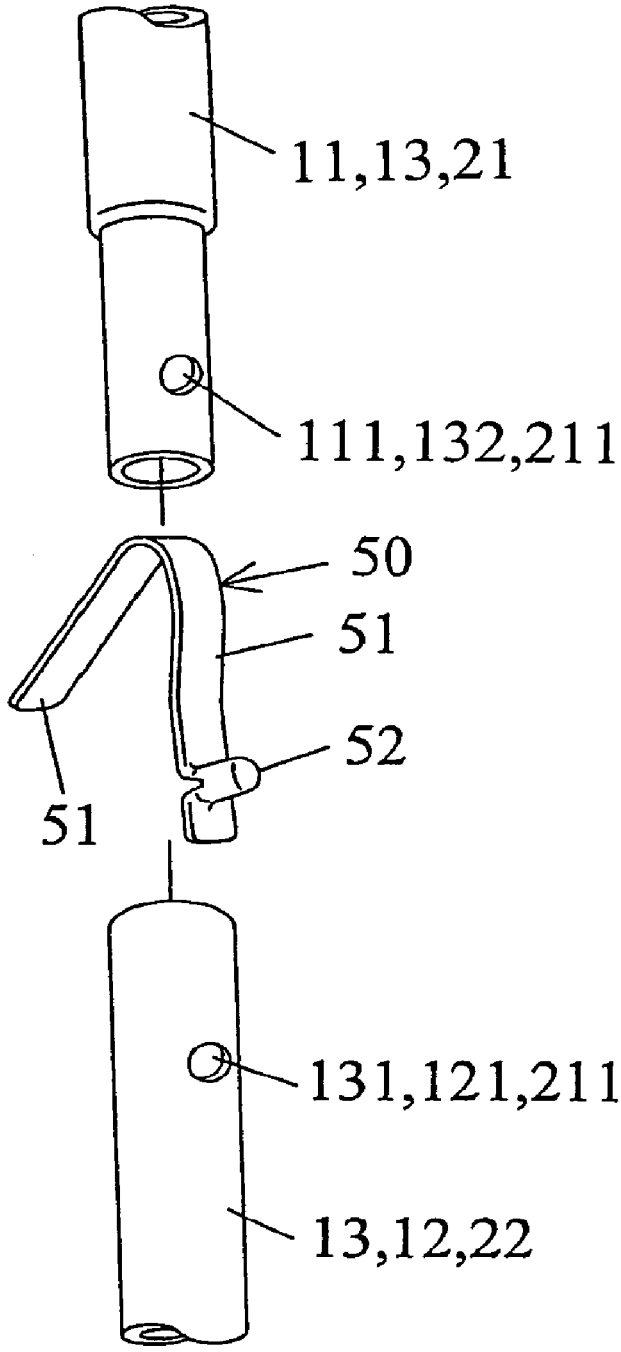
FIG. 4 is an exploded view showing engaging portions of the frame of the collapsible high chair of FIG. 2.

As shown in FIGS. 3 and 4, both ends of the upper front tube 11 and upper ends of the pair of middle front tubes 13 of the front frame 10 are configured to be connected to each other, and provided with corresponding holes 111, 131 respectively. A spring fastener 50 having two elastic arms 51 is in a V-shaped form, and one of the elastic arms 51 is provided with a projection 52. Each of the side ends of the upper front tube 11 of the front frame 10 contains the spring fastener 50 therein so that the projection 52 of the spring fastener 50 penetrates the hole 111 of the upper front tube 11 from the inside of the upper front tube 11 by an elastic force of the spring fastener 50, and projects outward therefrom. When both ends of the upper front tube 11 are connected to the upper ends of the pair of middle front tubes 13 and the hole 111 of the upper front tube 11 is aligned with the hole 131 of the middle front tube 13, the projection 52 of the spring fastener 50 penetrates the hole 131 of middle front tube 13 from the inside by the elastic force of the spring fastener 50 and projects outward therefrom, so that both side ends of the upper front tube 11 and the upper ends of the pair of middle front tubes 13 are connected to and fixed to each other. The spring fastener 50 is formed of metal, plastic or elastic material.

By the same way as described above, both ends of the lower front tube 12 of the front frame 10 are connected to lower ends of the pair of middle tubes 13 respectively, and the projection 52 of the spring fastener 50 penetrates a hole 132 of the middle front tube 13 and a hole 121 of the lower front tube 12 from the inside, so that both ends of the lower front tube 12 and the lower ends of the middle front tube 13 are connected and fixed to each other. Similarly, both ends of the lower rear tube 22 of the rear frame 20 are connected to both ends of the upper rear tube 21 of the rear frame 20 respectively, and the projection 52 of the spring fastener 50 penetrates a hole 211 of the upper rear tube 21 and a hole 221 of the lower rear tube 22, so that both side ends of the lower rear tube 22 and both side ends of the upper rear tube 21 are connected and fixed to each other.

When the high chair 100 is used, first, the front frame 10 and the rear frame 20 are assembled and expanded, the seat 40 is pivotally slid on the pair of middle front tubes 13 of the front frame 10 by the slide members 61 pivotally mounted to the seat 40 until the slide members 61 are blocked by the stoppers 62 on the middle front tubes 13, and then the front portion of the arm member 30 is fixed onto the upper rear tube 21 of the rear frame 20, thereby accomplishing the assembly and expansion of the high chair. The arm member 30 could be provided with a tray 32 if required (see FIG. 5).

Figure 5:
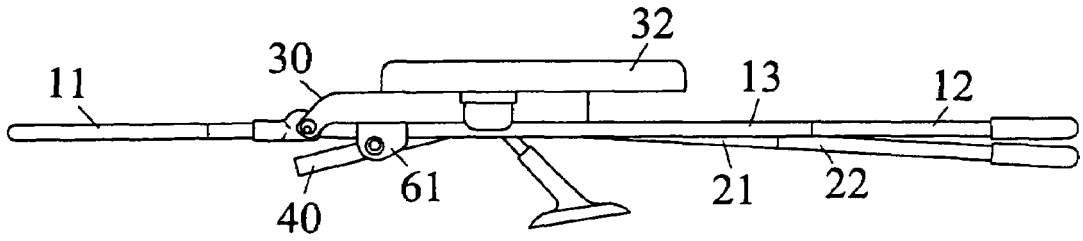
FIG. 5 is a side view showing the collapsible high chair of FIG. 2 in a collapsed state.
Figure 6:
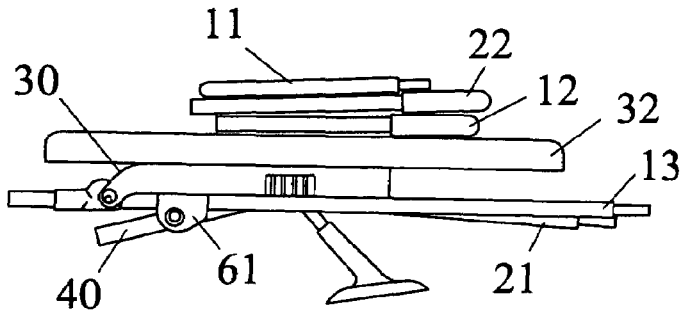
FIG. 6 is a side view showing the collapsible high chair of FIG. 2 in a collapsed state after being detached.

When the high chair 100 is unused, for example, during transportation or in storage, the arm member 30 is removed from the upper rear tube 21 of the rear frame 20 to allow the lower front tube 12 and the lower rear tube 22 to be approach to each other while the slide members 61 are moving on the middle front tubes 13, and the front portion of the seat 40 pivots with respect to the upper rear tube 21 and approaches to the lower front tube 12, so that the high chair 100 is collapsed as shown in FIG. 5. Subsequently, the projections 52 of the spring fasteners 50 contained in the middle front tubes 13, the upper front tube 11 and the upper rear tube 21 are pressed down to remove the upper front tube 11, the lower front tube 12 and the lower rear tube 22, and the tray 32 is detached from the arm member 30. Finally, the upper front tube 11, the lower front tube 12, the lower rear tube 22 and the tray 32 are stacked on the collapsed middle tubes 13, upper rear tube 21, arm member 30 and seat 40 as shown in FIG. 6, thereby saving a lot of space for facilitating transportation and storage.

Given the disclosure of the present invention, one skilled in the art would appreciate that there may be other embodiments and modifications within the scope of spirit of the present invention. Accordingly, all modifications attained by one skilled in the art from the present disclosure within the scope and spirits of the present invention are to be included as further embodiments of the present invention. The scope of the present invention accordingly is to be defined as set forth in the appended claims.

What is claimed is:

1. A collapsible high chair, comprising:

a front frame including a pair of middle front tubes and a substantially U-shaped lower front tube, the pair of middle front tubes and the lower front tube being detachably connected to each other by fastening devices;

a rear frame including a substantially U-shaped upper rear tube and a substantially U-shaped lower rear tube, the upper rear tube and the lower rear tube being detachably connected to each other by fastening devices; and a seat, the seat being pivotally connected to the rear frame and sliding pivotally on the front frame, wherein the front frame and the rear frame are pivotally connected to each other so that the front frame and the rear frame pivot and approach with respect to each other, thereby allowing the high chair to be in a collapsed state.

2. A collapsible high chair according to claim 1, wherein the front frame further comprises a substantially U-shaped upper front tube, the upper front tube and the pair of middle front tubes are detachably connected to each other by fastening devices.

3. A collapsible high chair according to claim 1, wherein front portions of both sides of the seat are pivotally connected to middle portions of both sides of the upper rear tube of the rear frame.

4. A collapsible high chair according to claim 1, wherein each of rear portions of both sides of the seat are pivotally connected to a slide member provided on an upper portion of each of the pair of middle front tubes of the front frame, so that the seat slides pivotally on the upper portions of the pair of middle front tubes of the front frame.

5. A collapsible high chair according to claim 1, wherein both ends of the upper rear tube are detachably engaged with both ends of the lower rear tube by the fastening devices respectively, and middle portions of both sides of the upper rear tube of the rear frame are pivotally connected to middle portions of the pair of middle front tubes of the front frame respectively.

6. A collapsible high chair according to claim 5, wherein each of the fastening devices has a projection for penetrating and engaging a hole provided on the tubes.

7. A collapsible high chair according to claim 6, wherein each of the fastening devices is substantially a V-shaped spring fastener having two elastic arms, and the projection is located in one of the elastic arms.

8. A collapsible high chair according to claim 7, wherein the spring fastener is formed of metal, plastic or elastic material.

9. A collapsible high chair according to claim 1, further comprising a substantially U-shaped arm member, the arm member being pivotally connected to the front frame and detachably fixed to the rear frame.

10. A collapsible high chair according to claim 9, wherein both ends of the arm member are pivotally connected to upper portions of the pair of middle front tubes of the front frame respectively.

11. A collapsible high chair according to claim 9, wherein a front portion of the arm member is detachably fixed to the upper rear tube of the rear frame.

12. A collapsible high chair according to claim 9, further comprising a tray, the tray being detachably provided on the arm member.

13. A collapsible high chair comprising:

a front frame including a first front portion and a second front portion detachably connected to the first front portion;

a rear frame including a first rear portion and a second rear portion detachably connected to the first rear portion, the first rear portion of the rear frame is pivotally connected to the first front portion of the front frame; and a seat, the seat being pivotally connected to the rear frame and sliding pivotally on the front frame;

wherein the high chair is movable between an expanded state where the front frame and the rear frame are spaced from each other, and a collapsed state where the front frame and the rear frame are close to each other.

14. A collapsible high chair comprising:

a front frame including a first front portion and a second front portion detachably connected to the first front portion by a first fastening device;

a rear frame including a first rear portion and a second rear portion detachably connected to the first rear portion by a second fastening device, the first rear portion of the rear frame is pivotally connected to the first front portion of the front frame for moving away from or toward the first front portion of the front frame so that the high chair can be moved between an expanded state and a collapsed state; and a seat, the seat being pivotally connected to the rear frame and sliding pivotally on the front frame, wherein the second front portion and the second rear portion are detached from the first front portion and the first rear portion respectively to make the high chair in a compact volume while the high chair is in the collapsed state.

15. A collapsible high chair according to claim 14, wherein the first fastening device includes a first V-shaped spring fastener on one of the first and second front portions and a first hole on the other of the first and second front portions, the first spring fastener includes a projection for passing through the first hole to couple the first and second front portions together, and the second fastening device includes a second V-shaped spring fastener on one of the first and second rear portions and a second hole on the other of the first and second rear portions, the second spring fastener includes a projection for passing through the second hole to couple the first and second rear portions together.

* * * * *